US006474391B1

(12) United States Patent
Schmidt

(10) Patent No.: US 6,474,391 B1
(45) Date of Patent: Nov. 5, 2002

(54) APPARATUS FOR APPLYING ADHESIVE TO THE SPINES OF STACKS OF SHEETS AND THE LIKE

(75) Inventor: Falko Schmidt, Nürtingen (DE)

(73) Assignee: WOMAKO Maschinenkonstruktionen GmbH, Nürtingen (DE)

( * ) Notice: Subject to any disclaimer, the term of this patent is extended or adjusted under 35 U.S.C. 154(b) by 0 days.

(21) Appl. No.: 09/216,871

(22) Filed: Dec. 21, 1998

(30) Foreign Application Priority Data

Dec. 20, 1997 (DE) ..... 197 56 958

(51) Int. Cl.[7] ..... B42B 5/00

(52) U.S. Cl. ..... 156/556; 156/578; 156/908; 412/33; 412/37

(58) Field of Search ..... 156/567, 578, 156/568, 538, 576, 908; 412/9, 18, 19, 20, 21, 33, 37

(56) References Cited

U.S. PATENT DOCUMENTS

| | | | | |
|---|---|---|---|---|
| 3,668,193 A | * | 6/1972 | King | 260/857 |
| 4,500,241 A | | 2/1985 | Peters et al. | |
| 4,745,660 A | * | 5/1988 | Betts et al. | 17/73 |
| 5,618,347 A | * | 4/1997 | Clare et al. | 118/314 |
| 5,980,182 A | * | 11/1999 | Yen | 412/21 |

FOREIGN PATENT DOCUMENTS

| | | |
|---|---|---|
| DE | 1936954 | 2/1971 |
| DE | 2904097 A1 | 8/1979 |
| DE | 3420875 A1 | 12/1984 |
| DE | 4111815 A1 | 10/1992 |
| EP | 0550913 A1 | 7/1993 |
| WO | 91/14510 | 10/1991 |

* cited by examiner

*Primary Examiner*—Curtis Mayes
*Assistant Examiner*—Sue A. Purvis
(74) *Attorney, Agent, or Firm*—Venable; Robert Kinberg

(57) ABSTRACT

An indexible turret delivers successive stacks of a series of stacks of overlapping paper sheets to an adhesive applying or coating station where the elongated spine of a freshly delivered stack assumes a predetermined position. An elongated carriage is movable longitudinally of the spine at the coating station and carries two mirror symmetrical nozzles one of which is activated to supply a coat of adhesive to the spine at the coating station while the carriage moves in one direction and the other of which is activated to apply a coat of adhesive to the spine of the next stack of the series while the carriage moves in the opposite direction. The nozzles have elongated slots extending transversely of the spine at the coating station, and each nozzle is mounted in a discrete frame and is adjustable in and/or with such frame transversely of as well as toward and away from the spine at the coating station. The frames carry pairs of roller followers which track the exposed sides of pairs of clamping elements forming part of the turret and serving to engage the stacks adjacent to their spines.

24 Claims, 3 Drawing Sheets

APPARATUS FOR APPLYING ADHESIVE TO THE SPINES OF STACKS OF SHEETS AND THE LIKE

CROSS-REFERENCE TO RELATED CASES

This application claims the priority of German patent application Serial No. 197 56 958.7 filed Dec. 20, 1987. The disclosure of this German patent application, as well as that of each other patent application and/or patent mentioned in the specification of the present application, is incorporated herein by reference.

BACKGROUND OF THE INVENTION

The invention relates to improvements in apparatus for applying coats or films of an adhesive to selected sides or surfaces (normally to the spines) of stacks, blocks or piles consisting of or comprising overlying or overlapping sheets, panels and/or plates of paper, cardboard or the like. For the sake of brevity and simplicity, the accumulations of sheet-like commodities will be referred to as stacks, and those selected elongated sides or surfaces of the stacks which are to be provided with films or coats of a suitable adhesive will be referred to as spines. Finished products which are obtained by resorting to the apparatus of the present invention can constitute legal pads or other types of stationery products, portions of books or the like.

It is well known to establish more or less permanent connections between selected edges of overlapping paper sheets or the like by providing such edges with a coat or film of a suitable adhesive. Reference may be had, for example, to published German patent application No. 34 20 875 A1 which discloses an apparatus wherein the means for applying a coat of adhesive to the spine of a stack of paper sheets or the like comprises a series of successive adhesive-applying rollers. Since the rollers must be caused to bear upon the spine of the stack which is located at the coating station, such apparatus cannot invariably ensure the application of an adhesive coat or layer having an optimum width. Moreover, such apparatus cannot apply to a spine an accurately selected quantity of adhesive; this can entail pronounced changes in the thickness and strength of the applied adhesive coat.

OBJECTS OF THE INVENTION

An object of the invention is to provide an apparatus which constitutes a pronounced improvement over the apparatus disclosed in the aforementioned published German patent application Serial No. 34 20 875 A1.

Another object of the invention is to provide an apparatus which can provide the spines of a short or long series of successive stacks of paper sheets or the like with adhesive films, layers or coats of optimum width.

A further object of the invention is to provide an apparatus which can ensure a predictable and optimal distribution of adhesive in the longitudinal and/or in the transverse direction of the spine of each of a short or long series of stacks of paper sheets or the like.

An additional object of the invention is to provide the improved apparatus with novel adhesive applying and distributing means.

Still another object of the invention is to provide an apparatus which can apply highly satisfactory coats or films of adhesive to the spines of large numbers of stacks per unit of time.

A further object of the invention is to provide an apparatus which can be readily and accurately adjusted to apply highly satisfactory coats or films of adhesive to relatively wide, relatively narrow, relatively long and/or relatively short spines of stacked paper sheets or the like.

Another object of the invention is to provide an apparatus which can properly treat stacks which consist of or contain relatively soft, relatively, hard, relatively stiff, readily flexible and/or other sheets with the same or at least satisfactory degree of facility and predicability.

An additional object of the invention is to provide a novel and improved conveyor for delivery of successive stacks of a series of stacks to the adhesive applying or coting station.

Still another object of the invention is to provide the above outlined apparatus with novel and improved means for supporting, advancing, adjusting and/or otherwise manipulating the adhesive applying implement or implements.

A further object of the invention is to provide a novel and improved method of applying films or coats of a flowable adhesive substance to the spines of stacked paper sheets or the like in such a way that the applied adhesive is prevented from contacting any and all surfaces other than the spines of the stacks.

Another object of the instant invention is to provide a series of stationery products or analogous products which are obtained or at least partially finished by resorting to the above outlined method and to the above outlined apparatus.

SUMMARY OF THE INVENTION

One feature of the present invention resides in the provision of an apparatus for applying coats of a suitable adhesive to selected elongated sides of a series of successive stacks of overlapping sheets at an adhesive applying or coating station. The improved apparatus comprises intermittently operated conveyor means for delivering successive stacks of the series to and for temporarily maintaining the thus delivered stacks at the coating station so that the selected elongated side of the stack at the coating station assumes a predetermined position and orientation, and means for applying a film or layer or coat of adhesive to the selected elongated side of the stack at the coating station. The means for applying comprises at least one adhesive discharging nozzle and means for moving the at least one nozzle longitudinally of and parallel to the entire selected elongated side of the stack at the coating station.

The at least one nozzle is preferably provided with a slot-shaped adhesive discharging orifice having a length which at least approximates the width of the selected elongated side of the stack at the coating station. The orifice extends transversely of such elongated side.

The apparatus preferably further comprises means for shifting the at least one nozzle between an operative position in which the nozzle can discharge adhesive against the selected elongated side of the stack at the coating station and an inoperative position in which the nozzle is spaced apart from the selected elongated side of the stack at the coating station.

Still further, the apparatus preferably comprises means for adjusting the at least one nozzle transversely of the selected elongated side of the stack at the coating station. The means for moving the at least one nozzle can comprise a frame which is movable longitudinally of the selected elongated side of the stack at the coating station, and the aforementioned means for adjusting can comprise a nozzle holder which is shiftable in the frame transversely of the selected elongated side of the stack at the coating station, and means for shifting the nozzle holder.

The conveyor means can comprise pairs of clamping elements which are arranged to engage the stacks adjacent to the respective selected elongated sides. The clamping elements are preferably provided with exposed surfaces which extend longitudinally of the selected elongated sides of the stacks being engaged by the clamping elements, and the moving means of such apparatus can comprise followers arranged to track the exposed surfaces of clamping elements which engage the stack at the coating station. Such moving means preferably further comprises the aforementioned frame which is movable longitudinally of the selected elongated side of the stack at the coating station and has elastic portions which are deformable transversely of the selected elongated side of the stack at the coating station. The followers can be mounted on or in the frame and each such follower is arranged to track the exposed surface of one of the two clamping elements for the stack at the coating station. The followers can include or constitute rollers. The arrangement can be such that one of the followers is rotatable relative to the frame and another follower is movable toward and away from the one follower transversely of the selected elongated side of the stack at the coating station. Still further, the moving means can comprise means (e.g., a fluid-operated or a resilient device) for yieldably urging the other follower toward the one follower.

In accordance with a presently preferred embodiment, the conveyor means comprises a turret indexible about an axis which is at least substantially parallel to the selected elongated side of the stack at the coating station. The turret has a plurality of axially parallel peripheral receptacles for portions of stacks, and each such receptacle includes a pair of clamping elements which engage the stack in the respective receptacle adjacent the selected elongated side of such stack. The axis of the turret is or can be at least substantially horizontal, and the coating station can be disposed at a level below such axis.

As already mentioned hereinbefore, the selected elongated sides can constitute elongated spines of the respective stacks, and the means for applying can comprise a plurality of adhesive discharging nozzles. The means for moving can comprise a carriage which is movable longitudinally of the spine at the coating station in a first direction and in a second direction counter to the first direction. As a rule, or at least in many instances, the nozzles of the aforementioned plurality of nozzles include first and second nozzles which are at least substantial mirror images of each other with reference to a plane extending at right angles to the aforementioned first and second directions and located between the two nozzles.

Each nozzle can have an elongated slot-shaped adhesive discharging orifice of a length at least approximating the width of the spines, and such orifices extend transversely of the spine on the stack at the coating station.

The nozzles are or can be activatable and deactivatable independently of each other to respectively discharge and interrupt the discharging of adhesive. The first nozzle is activated and the second nozzle is deactivated in response to movement of the carriage in the first direction, and the second nozzle is activated and the first nozzle is deactivated in response to movement of the carriage in the second direction.

The just described apparatus preferably further comprises means for shifting the first and second nozzles independently of each other between operative and inoperative positions in which the respective nozzle contacts and is spaced apart from the spine of the stack at the coating station.

The moving means preferably further comprises a discrete frame or support for each of the plurality of nozzles; the frames are supported by and they are shiftable relative to the carriage. Such moving means can further comprise means for shifting each of the frames relative to the carriage between a first and a second position in which the respective nozzle is ready to apply adhesive to and is spaced apart from the spine of the stack at the coating station. The nozzles are or can be adjustable in the respective frames transversely of the spine of the stack at the coating station, and the means for applying can further comprise means for adjusting the nozzles relative to the respective frames. Such adjusting means can comprise a discrete nozzle holder which is shiftably mounted in each of the frames for movement transversely of the spine of the stack at the coating station, and means for shifting the nozzle holders relative to the respective frames.

As already mentioned hereinbefore, the conveyor means can comprise pairs of clamping elements serving to engage the stacks adjacent the respective spines. Such clamping elements are preferably provided with exposed surfaces extending longitudinally of the spines of the stacks being engaged by the clamping elements, and the moving means of such apparatus preferably further comprises followers serving to track the exposed surfaces of clamping elements which engage the stack at the coating station. The aforementioned discrete frames are mounted on and are movable with the carriage and preferably have elastic portions which are deformable transversely of the spine of the stack at the coating station. The followers include pairs of followers carried by the frames, and each follower of each such pair serves to track the exposed surface of a different one of the clamping elements which engage the stack at the coating station.

The followers can include rollers and one roller of each pair is rotatable relative to the respective frame; the other roller of each pair is movable toward and away from the one roller of the respective pair transversely of the spine of the stack at the coating station. The means for applying can further include means for yieldably urging the other roller of each pair toward the one roller of the respective pair.

As already explained hereinbefore, a presently preferred conveyor means comprises a turret which is indexible about an axis that is at least substantially parallel to the spine of the stack at the coating station; the turret has a plurality of axially parallel peripheral receptacles for portions of stacks, and each receptacle includes a pair of clamping elements which engage the stack in the respective receptacle adjacent the spine of such stack. The axis of the turret is or can. be at least substantially horizontal, and the coating station is or can be installed at a level below such axis.

The novel features which are considered as characteristic of the invention are set forth in particular in the appended claims. The improved apparatus itself, however, both as to its contruction and the modes of assembling, installing and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
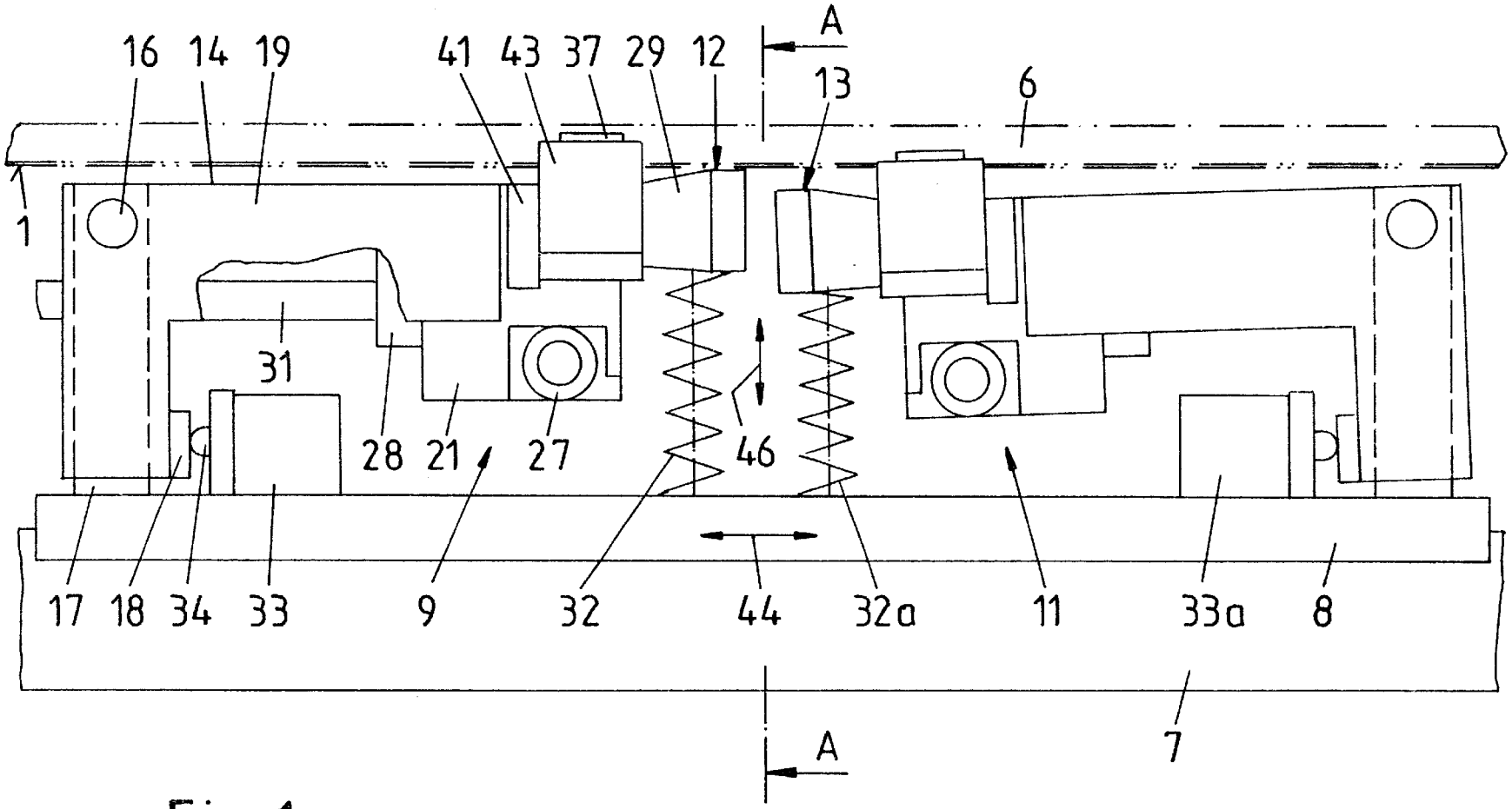
FIG. 1 is a somewhat schematic side elevational view of an apparatus which embodies one form of the invention.
Figure 2:
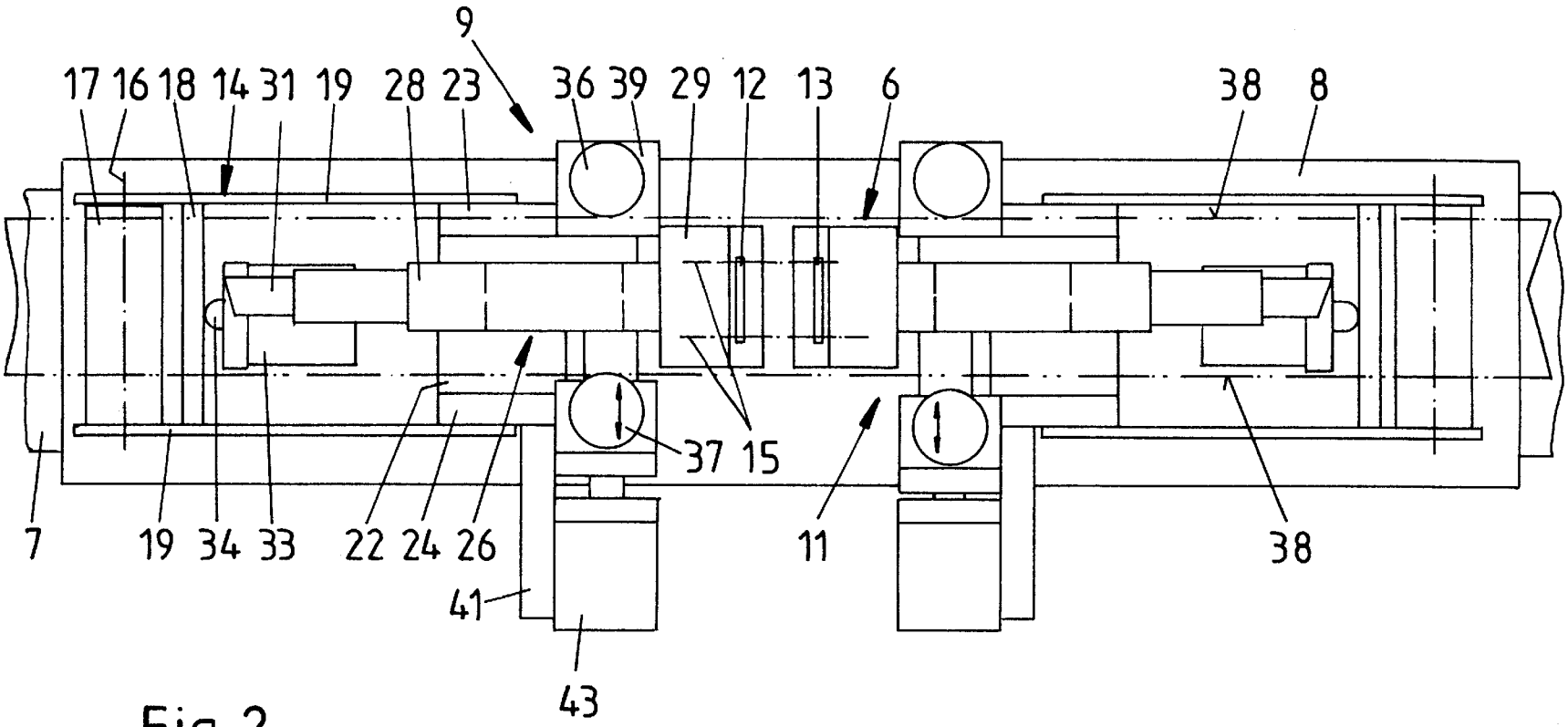
FIG. 2 is a plan view of the apparatus which is shown in FIG. 1.
Figure 3:
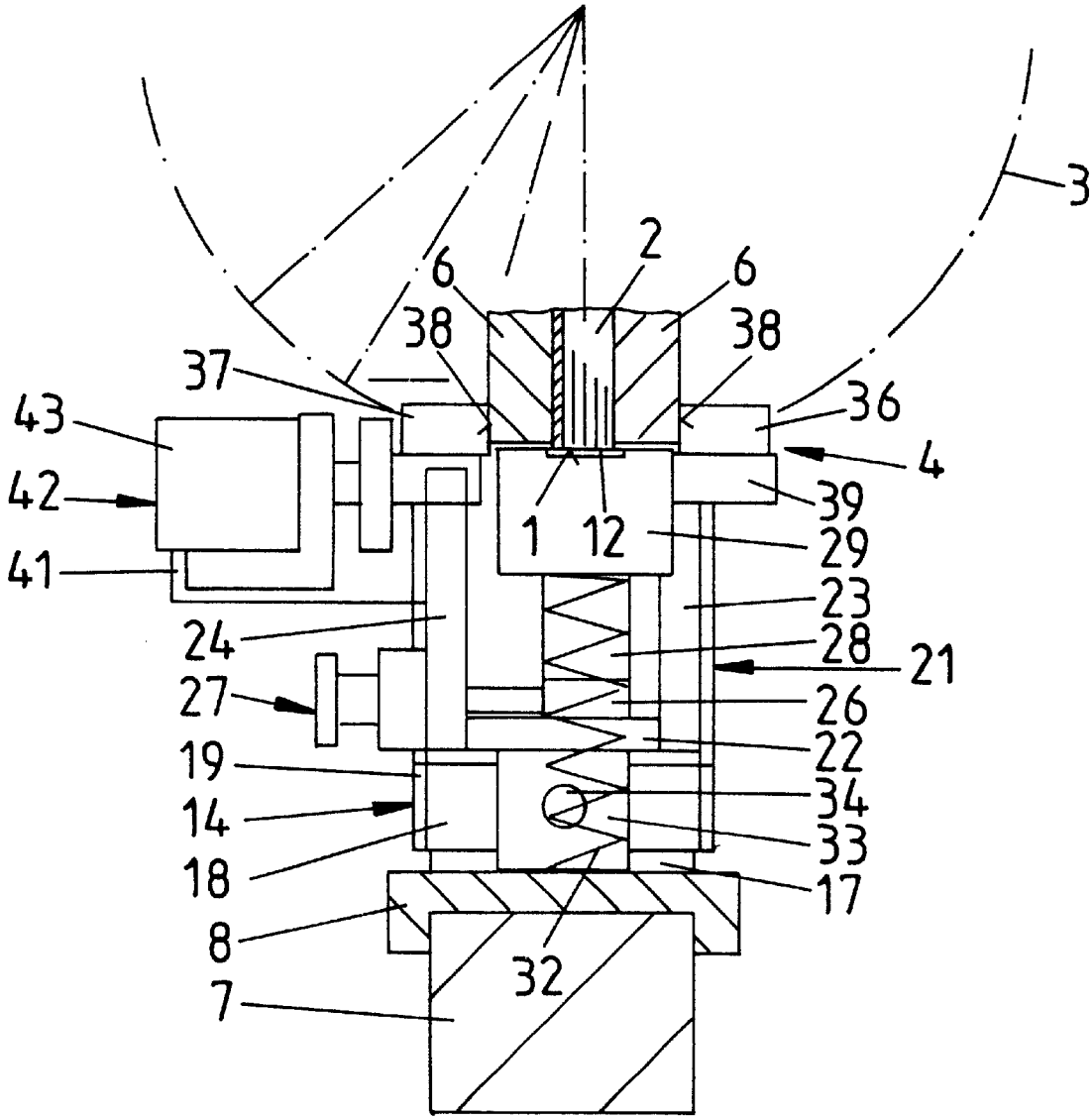
FIG. 3 is a somewhat schematic transverse vertical sectional view substantially as seen in the direction of arrows from the line A—A in FIG. 1.

The conveyor means of the apparatus which is shown in FIGS. 1 to 3 comprises a turret 3 (a portion of such turret is indicated in FIG. 3 by dot-dash lines) which is indexible about a horizontal axis and is provided with an array of axially parallel peripheral receptacles each flanked by two elongated bar- or strip-shaped clamping elements or jaws 6 which engage the stacks 2 of paper sheets or the like in such a way that the selected elongated sides or surfaces 1 (hereinafter called spines for short) remain accessible at the under-side (namely at the six o'clock position) of the turret 3, and more specifically at an adhesive applying or coating station 4. As can be seen in each of FIGS. 1 to 3, the coating station 4 is located at a level below the axis of the turret 3.

A similar turret is disclosed in published German patent application Serial No. 33 01 032 A1 corresponding to U.S. Pat. No. 4,500,241 the disclosure of which is incorporated herein by reference. The conveyor means further comprises customary means for indexing the turret 3 in stepwise fashion so as to move successive stacks 2 of a series of such stacks to the coating station 4 and to maintain each stack at such station for an interval of time which is required to complete the application of a film or coat of adhesive to the spine 1 at the six o'clock position of the turret. As can be seen in FIGS. 1 and 3, the spine 1 at the coating station 4 is located at a level slightly below the undersides of the respective clamping elements 6. FIG. 1 shows the spine 1 at the station 4 and one of the clamping elements 6 by dot-dash lines. The clamping elements 6 have exposed external surfaces 38 (shown by solid lines in FIG. 3 and by dot-dash lines in FIG. 2) which face away from the stacks 2 between them and serve to guide pairs of rotary guide elements 36, 37 (in the form of rollers) in a manner and for the purposes as will be fully described hereinafter.

The station 4 is located at a level above a straight elongated guide 7 (e.g., a rail) defining a straight elongated path which is parallel to the axis of the turret 3 and to the spine 1 of the stack 2 at the coating station 4. The guide 7 determines the movements of an elongated reciprocable carriage 8. The latter is movable in directions to the left and to the right (see the double-headed arrow 44 in FIG. 1) and supports two adhesive applying units 9, 11 which respectively comprise nozzles 12, 13. These nozzles are mirror images of each other with reference to a plane (see the plane A—A in FIG. 1) which is located between the two nozzles and is normal to the spine 1 of the stack 2 at the coating station 4. Since the unit 11 is identical with the unit 9 (except that it is installed as a mirror image of the unit 9), only the unit 9 will be described in full detail.

The adhesive applying unit 9 comprises a frame or support 14 which shares the movements of the carriage 8 in directions indicated by the arrow 44 and is pivotable relative to the carriage about the axis of a shaft 16 mounted on a pedestal or base 17 affixed to or forming part of the carriage. The frame 14 carries the nozzle 12 which is remote from the shaft 16 and is movable relative to the carriage 8 along an arcuate path between an operative (adhesive applying) position shown in the left-hand half of FIG. 1, and an inoperative position in which its elongated slot-shaped orifice is spaced apart from the spine 1 of the stack 2 at the coating station 4. The right-hand nozzle 13 (of the unit 11) of FIG. 1 is shown in its inoperative or retracted position. The means for shifting the nozzle 12 between its operative and inoperative positions comprises an actuating device 33 having a mobile pusher 34 which can pivot the frame 14 clockwise (as viewed in FIG. 1) in order to move the nozzle 12 to the inoperative position. A resilient element 32 (such as a coil spring) is provided to permanently urge the nozzle 12 to its operative position (by biasing the frame 14 in a counter-clockwise direction, as viewed in FIG. 1), e.g., to an operative position which is determined by the actuating device 33. The illustrated resilient element 32 reacts against the carriage 8 and bears upon a head 29 of the nozzle 12. The actuating device 33 is or can be coupled with the reversible motor for the carriage 8 in such a way that the nozzle 12 is operative (under the bias of the spring 32) while the carriage 8 moves in one direction but that the nozzle 12 is inoperative (in response to clockwise pivoting of the frame 14 by the pusher 34) when the carriage moves in the opposite direction.

The frame 14 comprises two sidewalls 19 which resemble bell crank levers and are elastically deformable toward and away from the observer of FIG. 1, i.e., transversely of the longitudinal direction of the spine 1 of the stack 2 at the coating station 4. Those portions of the sidewalls 19 which are adjacent the actuating device 33 are connected to each other by a plate-like connector 18 which can be engaged and moved by the pusher 34 when the frame 14 is to be pivoted clockwise (as viewed in FIG. 1), namely to move the nozzle 12 to its retracted or inoperative position. The sidewalls 19 are or can be pivotally mounted on the pedestal 17 of the carriage 8.

The nozzle 12 is mounted in a substantially U-shaped holder or carrier 21 having a bottom wall 22 and two sidewalls 23, 24 normal to the wall 22 and flanked by the elastically deformable sidewalls 19 of the frame 14. The bottom wall 22 supports an aligning slide 26 which is movable transversely of the spine 1 of the stack 2 at the coating station 4. The slide 26 supports a nozzle holder 28 which, in turn, carries the aforementioned head 29 of the nozzle 12. The means for adjusting the slide 26 (and hence the nozzle 12) transversely of the spine 1 of the stack 2 at the station 4 comprises a manually operated or a motor-driven device 27 which enables an operator or an automated adjusting system to move the elongated slot-shaped orifice in the head 29 of the nozzle 12 to an optimum position for the application of a coat or film of adhesive to the spine 1 at the station 4. Such application of adhesive takes place while the spring 32 is free to maintain the nozzle 12 in the operative position and while the carriage 8 is in the process of moving the frame 14 in one of the directions indicated by the arrow 44. The arrow 46 (shown in FIG. 1) indicates the directions of movement of the nozzle 12 between its operative (adhesive-discharging) and inoperative (retracted) positions.

A conduit 31 (e.g., in the form of a flexible hose) is provided to connect the head 29 of the nozzle 12 with a suitable source (not shown) of adhesive, e.g., with a refillable pot wherein the adhesive is maintained at a requisite pressure or which discharges adhesive by gravity flow.

The roller followers 36, 37 are mounted on the frame 14 in such a way that they can track the exposed surfaces 38 of the two clamping elements 6 at the coating station 4 while the carriage 8 is caused to move along the guide 7 in one of the directions indicated by the arrow 44. The roller followers cooperate with the surfaces 38 to ensure that the orifice of the nozzle 12 is compelled to travel along the entire spine 1 of the stack 2 at the station 4 in such position that the spine is coated across its entire width but that the adhesive issuing from the slot-shaped orifice of the nozzle 12 cannot contaminate the sides of the stack 2 and/or portions of the clamping elements 6 at the coating station 4.

The roller follower 36 is rotatably mounted on a bearing member or block 39 which is fixedly secured to the sidewall 23 of the U-shaped member 21. The aforementioned adjusting device 27 can move the nozzle holder 28 and the slide 26 transversely of the U-shaped member 21 so as to locate the nozzle 12 in an optimum position relative to the roller follower 36, i.e., relative to the spine 1 at the coating station 4.

The other roller follower 37 on the frame 14 is mounted in a frame-like element 41 which is carried by the U-shaped member 21, and this roller follower is movable transversely of the spine 1 at the station 4, i.e., toward and away from the roller follower 36. The means 43 for yieldably urging the roller follower 37 toward the roller follower 36 comprises a biasing arrangement 42 (e.g., a pneumatic accumulator and/or one or more resilient elements). The extent of movability of the roller follower 37 toward the roller follower 36 is limited by the exposed surface 38 of the clamping element 6 which confronts the roller follower 37 at the coating station 4. The biasing arrangement 42 is or can be carried by the frame-like element 41.

FIG. 1 merely identifies the compression spring 32*a* (analogous to the aforementioned spring 32 of the unit 9) and the actuating means 33*a* of the unit 11.

The mode of operation of the improved adhesive applying apparatus which is shown in FIGS. 1 to 3 is as follows:

The first step includes orienting the nozzles 12, 13 relative to the respective roller followers 36 (by the coresponding actuating means 33, 33*a*). Furthermore, and if the nozzle 12 is to discharge a layer of adhesive, the device 27 is caused to adjust (if necessary) the position of the aligning slide 26, of the nozzle holder 28 and the head 29 of the nozzle 12 transversely of the spine 1 at the coating station 4. Such adjustment takes place relative to the U-shaped member 21 and is completed when the distance of the slot-shaped orifice of the nozzle 12 from the roller follower 36 matches the distance of such roller follower and of the corresponding exposed surface 38 from the spine 1 at the station 4.

Conventionally, the length of a slot-shaped orifice in a nozzle will slightly exceed the width of a spine 1 to be coated with a layer of adhesive paste because the layer of adhesive issuing from such orifice undergoes a certain constriction (narrowing), normally during actual application to the spine. This can be seen in FIG. 2 wherein the spine 1 at the station 4 extends between the two dot-dash lines 15 and the distance between such lines is slightly less than the length of he slot-shaped orifices of the nozzles 12 and 13.

Since the roller follower 36 is not movable transversely of the station 4, and since this roller follower tracks the exposed surface 38 of the adjacent (then stationary) clamping element 6, a positioning of the nozzle 12 at a desired distance from the exposed surface 38 being tracked by the roller follower 36 is tantamount to locating the nozzle 12 in a predetermined position relative to the edges (lines 15 in FIG. 2) of the spine 1 at the station 4. The just discussed feature renders it possible to properly position the orifice of the nozzle 12 for movement along the full length of the spine 1 at the coating station 4 even if that side of the stack 2 at the station 4 which is nearer to the roller follower 36 comprises one or more soft and/or thin sheets of paper or the like. It has been found that the applied adhesive can reliably bond the soft and/or thin outer sheet(s) to the neighboring sheet(s) without risking a contamination of the front and/or rear side of the stack by an eventual surplus of adhesive.

At the start of an adhesive applying operation, the carriage 8 is held in one of two end positions in each of which the units 9, 11 and their frames 14 are located outside of the coating station 4, i.e., the carriage 8 and the parts which are mounted thereon do not interfere with indexing of the turret 3 to a new position in which an untreated stack 2 is held between the respective clamping elements 6 at the station 4. Once the turret 3 is brought to a halt, one of the nozzles 12, 13 (such as the nozzle 12) is moved from the inoperative position (FIG. 1 shows the nozzle 13 in the inoperative position and the nozzle 12 in the operative position). Such movement is effected (as far as the nozzle 12 is concerned) by the spring 32 in one of the directions indicated by the double-headed arrow 46. At such time, the actuating means 33 and its pusher 34 permit the frame 14 for the nozzle 12 to pivot in a counterclockwise direction. At the same time, the nozzle 12 is activated. e.g., in response to opening of a valve in or for the hose 31 so that the orifice of the nozzle 12 can receive adhesive from the aforementioned source. The arrangement is or can be such that the nozzle 12 can discharge adhesive only during travel of the carriage 8, i.e., while the orifice of the nozzle 12 sweeps along the spine 1 of the stack 2 at the coating station 4.

At such time, the activating means 33*a* positions the nozzle 13 in the retracted or inoperative position shown in FIG. 1 (i.e., the spring 32*a* is caused to store energy or to store additional energy). Furthermore, the nozzle 13 is then sealed from the source of adhesive. The two nozzles can receive adhesive from a common source.

The next step involves a movement of the carriage 8 relative to the coating station 4 (e.g., in a direction from the right to the left, as viewed in FIG. 1). The roller followers 36, 37 cooperate with the exposed surfaces 38 of the two clamping elements 6 at the station 4 to ensure that the nozzle 12 applies a film or coat or layer of adhesive paste in an optimum manner. The elasticity of the sidewalls 19 of the frame 14 for the nozzle 12 renders it possible to compensate for eventual inaccuracies, e.g., for departures of movement of the carriage 8 along the guide 7 from an ideal or optimum movement. Moreover, the elastic sidewalls 19 ensure that the roller followers 36, 37 remain in uninterrupted contact with the exposed surfaces 38 of the respective clamping elements 6 at the coating station 4, even if the direction of movement of the carriage 8 along the guide 7 slightly departs from the longitudinal direction of the spine 1 at the station 4. In other words, the feature that the sidewalls 19 are elastically deformable (or that at least one of these sidewalls is elastically deformable) compensates for at least some inaccuracies (including play, e.g., as a result of wear) of guidance of the carriage 8 and hence also of the frame 14 for the unit 9 during application of adhesive paste to the spine 1 of the stack 2 confronting the advancing nozzle 12. This has been found to contribute to the quality of the adhesive applying operation.

Once the coating of the spine 1 at the station 4 by the nozzle 12 is completed, the units 9, 11 on the carriage 8 are again located outside of such station and the turret 3 can be indexed to advance the freshly treated stack 2 beyond the station 4 and to deliver a further (still uncoated) stack into the range of the nozzle 13. The nozzle 12 is deactivated and pivoted to the inoperative position while the nozzle 13 is free to receive adhesive from the source. The carriage 8 is moved in a direction from the left to the right (as viewed in FIG. 1), and the nozzle 13 applies a coat of adhesive to the spine 1 at the station 4 while the roller followers on the frame for the nozzle 13 track the external surfaces 38 of the clamping elements 6 which are then located at the coating station.

An advantage of plural nozzles is that the improved apparatus can treat stacks 2 at a higher frequency because each and every movement of the carriage 8 along the coating station 4 entails the application of a film of adhesive to a freshly delivered stack.

It is also within the purview of the invention to provide the carriage 8 with a single adhesive applying unit (9 or 11) and to employ a single nozzle (12 or 13) which is arranged to apply adhesive to the spine of a different stack at the station 4 during each movement of the single nozzle along the coating station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of applying adhesive to the spines of stacks of sheets and the like and, therefore, such adaptations should and are intended to be comprehended within the meaning and range of equivalence of the appended claims.

What is claimed is:

1. Apparatus for applying coats of an adhesive to selected elongated sides having a predetermined width of a series of successive stacks of overlapping sheets at a coating station, comprising:

intermittently operated conveyor means for delivering successive stacks of said series to and for temporarily maintaining the thus delivered stacks at said station so that the selected elongated side of the stack at said station temporarily assumes a predetermined position and orientation, wherein said conveyor means comprises pairs of clamping elements arranged to engage the stacks adjacent to the respective selected elongated sides; and means for applying a coat of adhesive to the selected elongated side of the stack at said station, wherein said means for applying includes at least one adhesive discharging nozzle having a slot-shaped adhesive discharging orifice having a length at least approximating said predetermined width and extending transversely of the elongated side of the stack at said station, wherein said means for applying includes means for contacting said at least one adhesive discharging nozzle to the elongated side of the stack at said station, wherein said means for applying further includes means for moving said at least one nozzle longitudinally of and parallel to the entire selected elongated side of the stack at said station, wherein said clamping elements include exposed surfaces extending longitudinally of the selected elongated sides of the stacks being engaged by the clamping elements, and wherein said means for moving include followers arranged to track the exposed surfaces of the clamping elements engaging the stack at the station.

2. The apparatus of claim 1, further comprising means for shifting said at least one nozzle between an operative position in which the nozzle can discharge adhesive against the selected elongated side of the stack at said station and an inoperative position in which the nozzle is spaced apart from the selected elongated side of the stack at said station.

3. The apparatus of claim 1, further comprising means for adjusting said at least one nozzle transversely of the selected elongated side of the stack at said station.

4. The apparatus of claim 3, wherein said means for moving comprises a frame movable longitudinally of the selected elongated side of the stack at said station, said means for adjusting comprising a nozzle holder shiftable in said frame transversely of the selected elongated side of the stack at said station and means for shifting said nozzle holder.

5. The apparatus of claim 1, wherein said moving means further comprises a frame movable longitudinally of the selected elongated side of the stack at said station and having elastic portions deformable transversely of the selected elongated side of the stack at said station, said followers being provided on said frame and each thereof being arranged to track one of said exposed surfaces.

6. The apparatus of claim 5, wherein said followers include rollers.

7. The apparatus of claim 5, wherein one of said followers is rotatable relative to said frame and another of said followers is movable toward and away from said one follower transversely of the selected elongated side of the stack at said station.

8. The apparatus of claim 7, wherein said moving means further comprises means for yieldably urging said other follower toward said one follower.

9. The apparatus of claim 1, wherein said conveyor means comprises a turret indexible about an axis which is at least substantially parallel to the selected elongated side of the stack at said station, said turret having a plurality of axially parallel peripheral receptacles for portions of stacks and each of said receptacles including a pair of clamping elements engaging the stack in the respective receptacle adjacent the selectee elongated side of such stack.

10. The apparatus of claim 9, wherein said axis is at least substantially horizontal and said station is located at a level below said axis.

11. The apparatus of claim 1, wherein said selected elongated sides constitute elongated spines of the respective stacks and said at least one nozzle comprises a plurality of nozzles, said means for moving comprising a carriage movable longitudinally of the spine at said station in a first direction and in a second direction counter to said first direction.

12. The apparatus of claim 11, wherein the nozzles of said plurality of nozzles include first and second nozzles which are at least substantial mirror images of each other with reference to a plane extending at right angles to said directions.

13. The apparatus of claim 12, wherein said nozzles are activatable and deactivatable independently of each other to respectively discharge and interrupt the discharging of adhesive, said first nozzle being activated and said second nozzle being deactivated in response to movement of said carriage in said first direction, said second nozzle being activated and said first nozzle being deactivated in response to movement of said carriage in said second direction.

14. The apparatus of claim 12, further comprising means for shifting said first and second nozzles independently of each other between operative and inoperative positions in which the respective nozzle contacts and is spaced apart from the spine at said station.

15. The apparatus of claim 11, wherein said moving means further comprises a discrete frame for each of said nozzles, said frames being supported by an being shiftable relative to said carriage.

16. The apparatus of claim 15, wherein said moving means further comprises means for shifting each of said frames relative to said carriage between a first and a second position in which the respective nozzle is ready to apply adhesive to and is spaced apart from the spine at said station.

17. The apparatus of claim 15, wherein said nozzles are adjustable in the respective frames transversely of the spine of the stack at said station, said means for applying further comprising means for adjusting said nozzles relative to the respective frames.

18. The apparatus of claim 17, wherein said means for adjusting comprises a discrete nozzle holder shiftably mounted in each of said frames for movement transversely of the spine of the stack at said station, and means for shifting said nozzle holders relative to the respective frames.

19. The apparatus of claim 11, wherein said moving means further comprises a discrete frame for of said nozzles, said frames being mounted on and being movable with said carriage and having elastic portions deformable transversely of the spine of the stack at said station, said followers including a pair of followers carried by each of said frames and each follower of each of said frames and each follower of each of said pairs being arranged to track the exposed surface of a different one of the clamping elements engaging the stack at said station.

20. The apparatus of claim 19, wherein said followers include rollers.

21. The apparatus of claim 20, wherein one follower of each pair is rotatable relative to the respective frame and the other follower of each pair is movable toward and away from the one follower of the respective pair transversely of the spine of the stack at said station.

22. The apparatus of claim 21, wherein said means for applying further comprises means for yieldably urging the other follower of each pair toward the one follower of the respective pair.

23. The apparatus of claim 11, wherein said conveyor means comprises a turret indexible about an axis which is at least substantially parallel to the spine of the stack at said station, said turret having a plurality of axially parallel peripheral receptacles for portions of stacks and each of said receptacles including a pair of clamping elements engaging the stack in the respective receptacle adjacent the spine of such stack.

24. The apparatus of claim 23, wherein said axis is at least substantially horizontal and said station is located at a level below said axis.

* * * * *